US006174100B1

(12) United States Patent
Song

(10) Patent No.: US 6,174,100 B1
(45) Date of Patent: Jan. 16, 2001

(54) PIN BINDING ASSEMBLY

(75) Inventor: Jun Ming Song, Wu Han (CN)

(73) Assignee: Leco Stationery Manufacturing Co., Ltd., Kwai Chung (HK)

( * ) Notice: Under 35 U.S.C. 154(b), the term of this patent shall be extended for 0 days.

(21) Appl. No.: 09/217,930

(22) Filed: Dec. 22, 1998

(51) Int. Cl.[7] ..... B42F 3/00

(52) U.S. Cl. ..... 402/60; 402/27; 402/46; 402/48; 402/19; 402/51; 402/54; 402/55; 402/56; 402/60

(58) Field of Search ..... 402/46, 48, 49, 402/27, 51, 54, 55, 56, 60

(56) References Cited

U.S. PATENT DOCUMENTS 2,915,068 * 12/1959 Miyamoto ..... 129/24
4,693,625 9/1987 Ohminato .
5,330,280 * 7/1994 Kaneda et al. ..... 402/49
5,634,732 * 6/1997 Ushirooka et al. ..... 402/46
5,722,783 * 3/1998 Kiyomi ..... 402/70

* cited by examiner

*Primary Examiner*—Stephen F. Gerrity
*Assistant Examiner*—Daniel Phan

(57) ABSTRACT

A binding assembly includes first and second sheet retaining members which are releasably attached to a base member by first and second latching mechanisms. The sheet retaining members include a pair of side members which support a pair of pins and tubes onto which sheets of paper or other materials are placed. Each of the side members includes an engaging rod which is receivable in a channel provided in the base member to retain the sheet retaining members to the base member. Each of the latching mechanisms are independently pivotable about an axis perpendicular to the pins and tubes from a retaining position where the sheet retaining members are constrained to the base member, to a releasing position where the sheet retaining members may be detached from the base member.

22 Claims, 10 Drawing Sheets

PIN BINDING ASSEMBLY

BACKGROUND OF THE INVENTION

1. Field of the Invention

The present invention relates to a binding assembly for retaining sheets of material, such as paper, and more particularly, to a binding assembly having a pair of side plates which are independently detachable from a base member so that sheets may be inserted or removed from either side of the binding assembly.

2. Description of the Background Art

Various binding assemblies are known in the prior art for retaining sheets of paper or other materials together in an orderly fashion. The binding assemblies are usually attached to a cover member to form a notebook or binder. Typically, a plurality of holes are punched along a side edge of sheets of paper, and pins or tubes of the binding assembly are passed through the holes to retain the sheets of paper together.

One example of such a binding device is shown in U.S. Pat. No. 4,693,625, which shows a binding assembly having a pair of side members which support a pair of pins and tubes onto which the sheets of paper are placed. The side members are detachable from a base member which is fixed to the spine of a notebook cover. Each of the side members includes a pair of engaging rods which are inserted into hollow portions in the base member to retain the side members to the base member. The engaging rods are movable along the length of the respective side member by a sliding plate disposed within the side member which is slidable along the length of the side member. The sliding plate transfers a force provided by a user in a direction of the length of the side member to the engaging rods, so that the side member may be detached from the base member. Unfortunately, the detaching mechanism is complicated, and therefore costly to produce. Further, because the side members must be relatively thick to accommodate the components of the detaching mechanism therein, there remains less room for the sheets of paper for a fixed width of binder cover, and thus the capacity of the binding assembly is limited. Finally, only short portions of the engaging rods are held by the hollow portions of the base member, and therefore the retaining strength is limited.

Another example of a binding device is shown in U.S. Pat. No. 5,330,280, which shows a binding assembly also having a pair of side members which support a pair of pins and tubes onto which the sheets of paper are placed. Each of the side members includes a pair of engaging rods which are inserted into hollow portions in the base member to detachably retain the side members to the base member. The engaging rods are movable along the length of the respective side member by an actuating mechanism which is slidable in the direction of the length of the side member. Similarly to the previously discussed patent, the actuating mechanism transfers a force provided by a user in the direction of the length of the side member to the engaging rods, so that the side member may be detached from the base member. A series of actuating mechanisms are shown in the various embodiments, all of which are extremely complex. However, as the number of components and the complexity of a device increases, the cost to manufacture increases, and the number of components that can malfunction increases. Further, since only short portions of the engaging rods are held by the hollow portions of the base member, the retaining strength is also limited.

A final example of a binding device is shown in U.S. Pat. No. 5,634,732, which shows a binding assembly also having a pair of side members which support a pair of pins and tubes onto which the sheets of paper are placed. Each of the side members includes a pair of fixed engaging rods which are retained by a pair of latches provided on the base member. The pair of latches are movable along the width of the base member by depressing an actuating knob attached to the latches. As the knob is pressed inwardly, the latches move inwardly, and allow the engaging rods to move therepast to release the side member. However, the placement and actuation direction of the latch assemblies promotes inadvertent release of the side members by contact of the actuating knob with the front or rear cover members of the notebook binder. Also, other materials located loosely within the notebook may become wedged between the cover member and the actuating knob, resulting in inadvertent release of the side members. Finally, the latch assemblies are made of plastic material, and are susceptible to increased wear and breakage.

SUMMARY OF THE INVENTION

It is therefore an object of the present invention to provide a binding apparatus which has few components, and which is inexpensive to manufacture.

It is another object of the present invention to provide a binding apparatus in which the capacity of the binding assembly is increased.

It is yet another object of the present invention to provide a binding apparatus in which longer portions of the engaging rods are held by the latching mechanism, and therefore the retaining strength is increased.

It is yet still another object of the present invention to provide a binding apparatus which minimizes the possibility of inadvertent release of the sheet retaining members from the latching members.

These and other objects of the present invention are fulfilled by a binding apparatus including a base member and a sheet retaining apparatus having at least one pin. Either the sheet retaining apparatus or the base member includes an engaging rod, and the other one of the sheet retaining apparatus and the base member includes a latching member for securing the sheet retaining apparatus to the base member. The latching member is pivotable about an axis substantially parallel to the engaging rod from a retaining position where the sheet retaining apparatus is secured to the base member, to a releasing position where the sheet retaining apparatus may be detached from the base member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
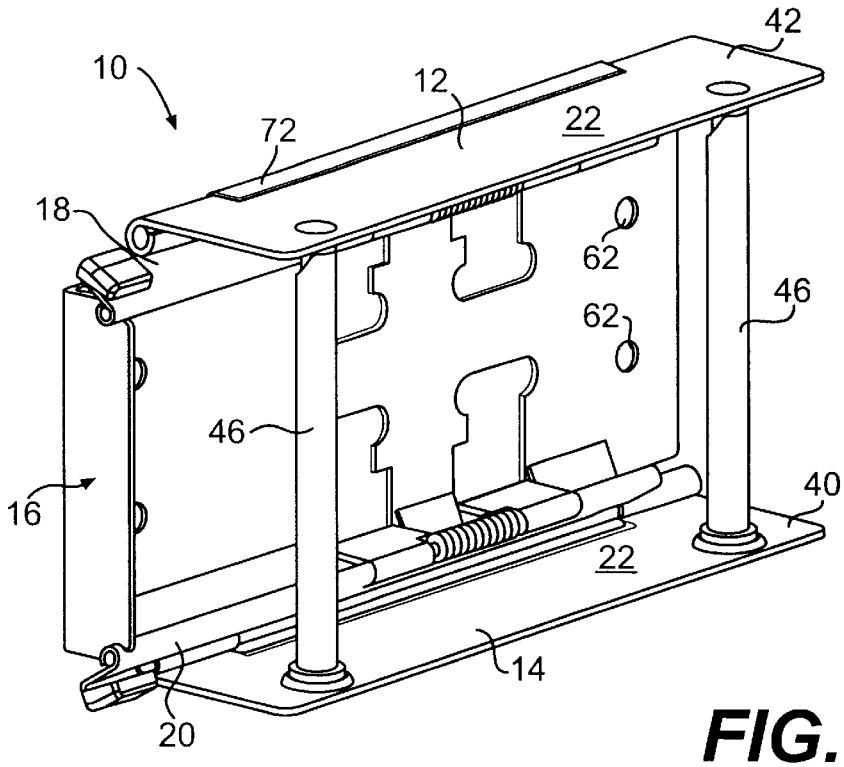
FIG. 1 is a perspective view of the binding assembly of the present invention in an assembled condition.
Figure 2:
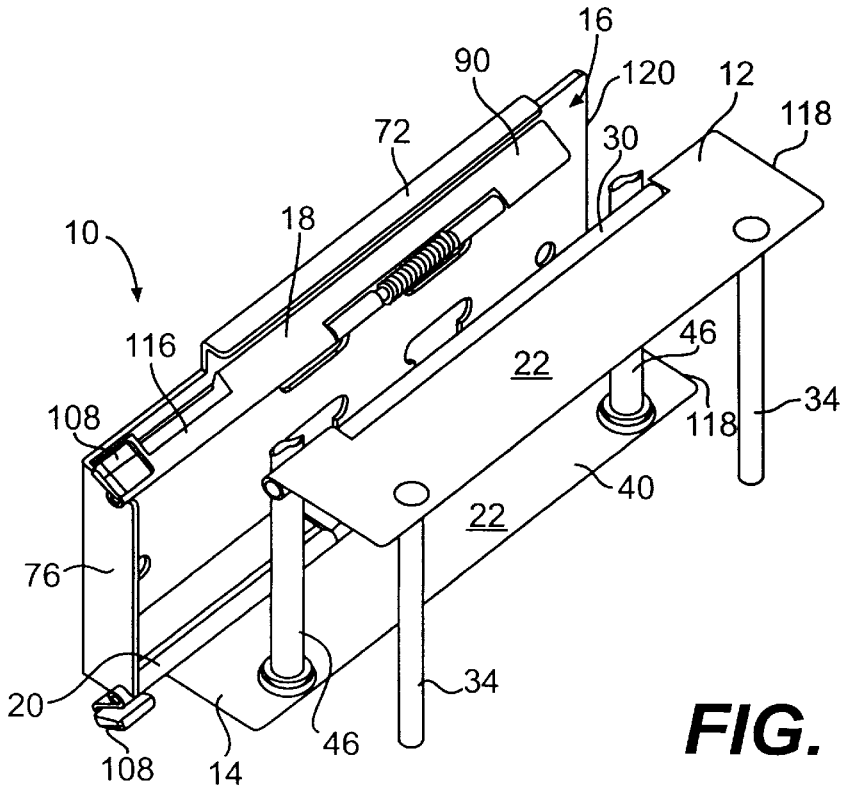
FIG. 2 is a perspective view of the binding assembly of the present invention in a partially disassembled condition.
Figure 3:
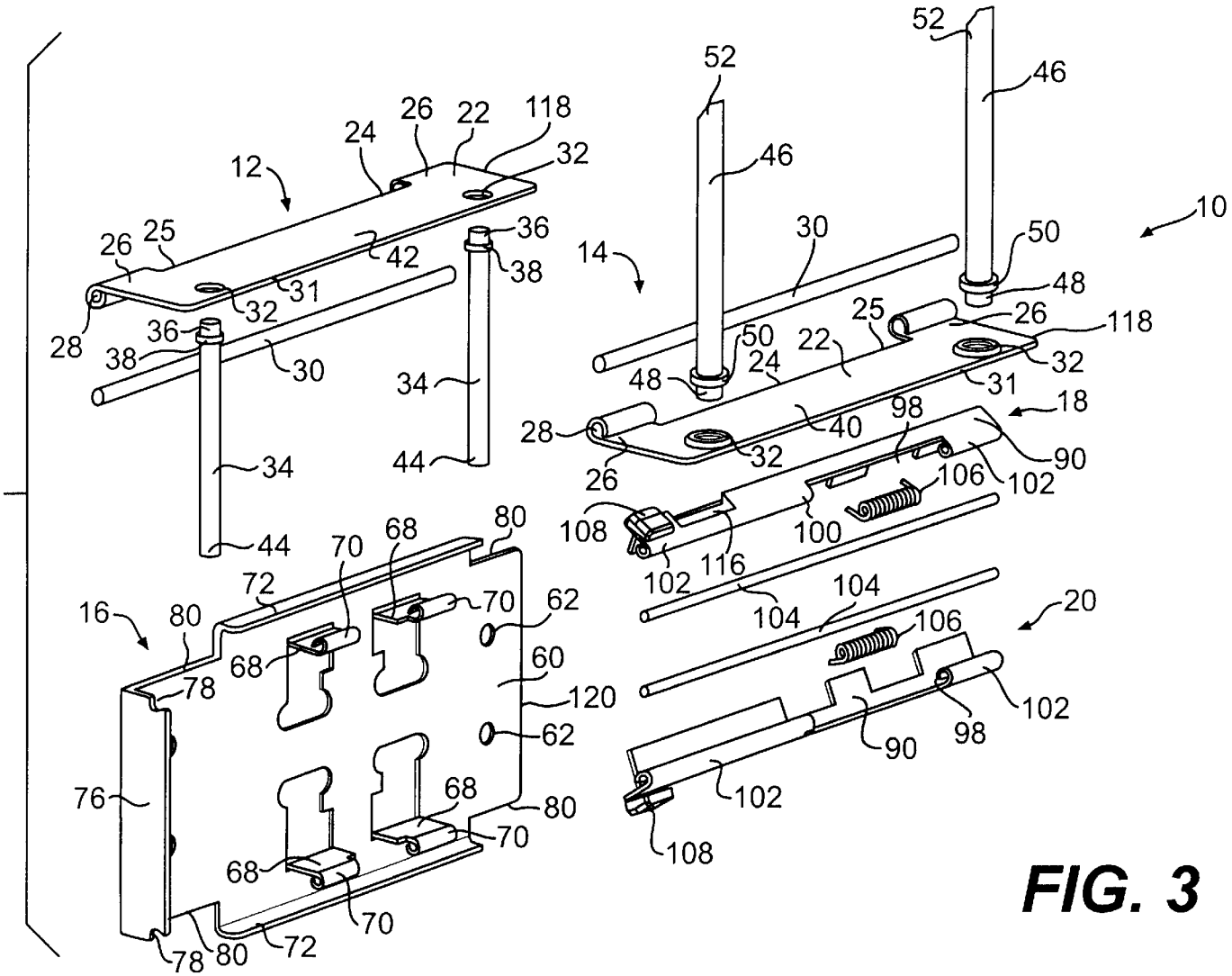
FIG. 3 is an exploded perspective view of the binding assembly of the present invention.

Referring in detail to the drawings, and with particular reference to FIGS. 1–3, a binding apparatus 10 of the present invention is shown. The binding apparatus 10 includes first and second sheet retaining members 12,14 which are releasably attached to a base member 16 by first and second latching mechanisms 18,20, respectively.

The first and second sheet retaining members 12,14 each comprise a side plate 22 having a generally rectangular shape. The side plate 22 has a cut-away portion 24 located centrally along one edge 25 thereof. Remaining portions of the side plate 22 which are adjacent to the cut-away portion 24 form a pair of spaced-apart extensions 26. The ends of each of the extensions 26 are rolled inwardly to form a pair of engaging rod support pipes 28 having a tubular configuration. An engaging rod 30 extends along the side plate 22 between the engaging rod support pipes 28. The two ends of the engaging rod 30 are fixed to the engaging rod support pipes 28.

A second edge 31 opposite to the first edge 25 may be turned inwardly at a right angle to the side plate 22, or may be folded over to form a hem edge, in order to reduce sharp edges and to reinforce the side plate 22. The side plate 22 further includes a pair of apertures 32 extending therethrough. The centers of the apertures are spaced apart by a distance corresponding to the distance between a pair of holes in sheets of material to be held by the binding apparatus 10.

In the first sheet retaining member 12, a pair of pins 34 are fixed to the side plate 22 and extend inwardly therefrom. The pins 34 are preferably solid and have a generally circular cross-section. A first end 36 of each pin 34 includes a circular flange 38 having a diameter larger than that of the pin 34. The first end 36 of each pin 34 is inserted through the apertures 32 in the side plate 22 until the flanges 38 abut an inner surface 40 of the side plate 22. The first end 36 of each pin 34 is thereafter enlarged, for example, by pressing the first end 36 of the pins 34 against an outer surface 42 of the side plate 22 to form an enlarged head, to securely fasten the pins 34 to the side plate 22. A second end 44 of each pin 34 is rounded to reduce sharp edges and to assist with the placement of sheets of material onto the pins 34.

In the second sheet retaining member 14, a pair of tubes 46 are fixed to the side plate 22 and extend inwardly therefrom. The tubes 46 are hollow and have a generally circular cross-section. A first end 48 of each tube 46 includes a circular flange 50 having a diameter larger than that of the tube 46. The first end 48 of each tube 46 is inserted through the apertures 32 in the side plate 22 until the flanges 50 abut an inner surface 40 of the side plate 22. The first end 48 of each tube 46 is thereafter enlarged, for example, by pressing the first end 48 of the tubes 46 against an outer surface 42 of the side plate 22 to form a flared head, to securely fasten the tubes 46 to the side plate 22. A second end 52 of each tube 46 is angled to assist with the placement of sheets of material onto the tubes 46, and to assist in guiding the pins 34 into the tubes 46.

Although two pins 34 and two tubes 46 are shown in the present embodiment, it should be understood that three pins 34 and tubes 46, or any number of pins 34 and tubes 46, may be utilized as desired with the present invention.

Figure 5:
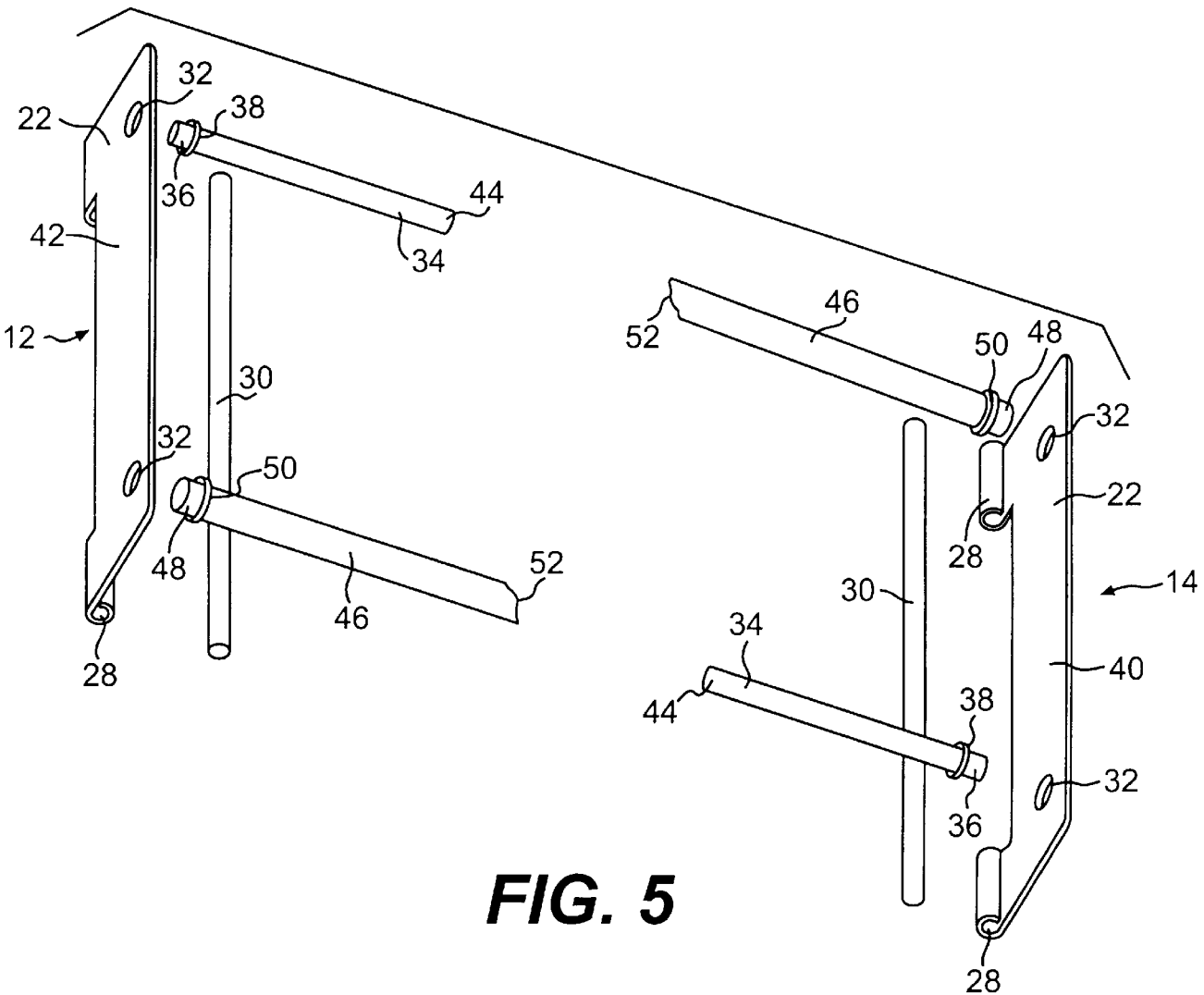
FIG. 5 is an exploded view of an alternative arrangement of the pins and tubes of the binding assembly of the present invention.

An alternative arrangement of the pins 34 and the tubes 46 of the first and second sheet retaining devices 12,14 is shown in FIG. 5. Therein, each of the side plates 22 includes a pin 34 and a tube 46 attached thereto, which compatibly mate with a corresponding tube 46 and pin 34, respectively, on the opposite side plate 22. Accordingly it can be seen that if the first and second sheet retaining members 12,14 are configured as shown in FIG. 5, the first and second sheet retaining members 12,14 are identical, and interchangeable from one side to the other. Thus, it is only necessary to manufacture a single sheet retaining member which can perform the function of the two different sheet retaining members 12,14 shown in the first embodiment, resulting in additional cost savings.

The base member 16 is preferably formed from a flat sheet of metal, and includes a substantially rectangular bottom plate 60. The bottom plate includes four holes 62 extending therethrough. As shown in FIG. 4*a* for example, rivets 64 extend through the holes 62 in the bottom plate 60 for attaching the base member 16 to a binder cover member 66.

Four portions from a central area of the bottom plate 60 are punched out and upwardly bent at approximately a right angle to the bottom plate 60 to form two pairs of spaced-apart upstanding supports 68. Distal ends of the upstanding supports 68 are rolled outwardly to form two pairs of aligned pivot shaft support pipes 70.

Side edges 72 of the base member 16 are bent upwardly at approximately a right angle to the bottom plate 60. The side edges 72 and the adjacent side portions of the bottom plate 60 form two sides of an engaging rod receiving channel 74.

One end 76 of base member 16 is upwardly bent at approximately a right angle to the bottom plate 60. Corners of the end 76 are removed to form end supports 78 for the latching mechanisms 18,20, which will be described in detail below.

Each of the four corners of the bottom plate 60 includes a rectangular cut-away portion 80 which provides a clearance for the engaging rod support pipes 28 of the side plates 22 when the sheet retaining members 12,14 are assembled with the base member 16.

Figure 4:
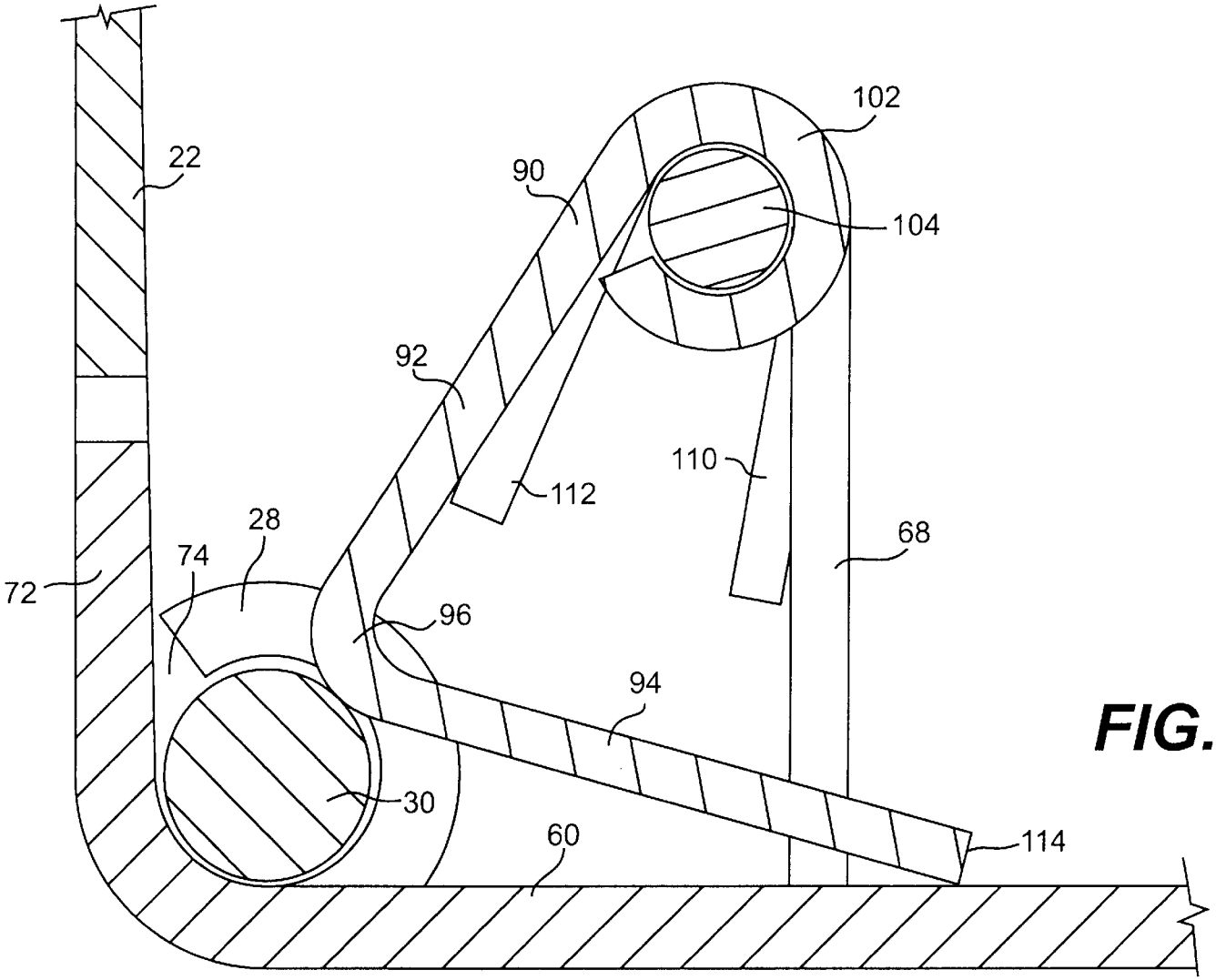
FIG. 4 is an enlarged cross-sectional view of the latching mechanism of the present invention.

The first and second latching mechanisms 18, 20 each include a latching member 90 which has a generally L-shaped cross section as shown in FIG. 4. The L-shaped cross section comprises a back portion 92, a bottom portion 94, and a corner portion 96 therebetween.

The back portion 92 has a cut-away portion 98 located centrally along an upper edge 100 thereof. Remaining portions of the back portion 92 which are adjacent to the cut-away portion 98 have ends which are rolled inwardly to form a pair of pivot shaft support pipes 102 having a tubular configuration. A pivot shaft 104 extends along the back portion 92 of the latching member 90 between the pivot shaft support pipes 102. The two ends of the pivot shaft 104 are located within the pivot shaft support pipes 102. A helical torsion spring 106 surrounds a portion of the pivot shaft 104 which is located in the cut-away portion 98 of the back portion 92.

One end of each of the latching members 90 includes a finger pad 108 which provides a convenient pressing point accessible by a user for actuating the latching mechanisms 18,20.

The latching mechanisms 18,20 are assembled to the base member 16 by aligning the pivot shaft support pipes 70,102 of the base member 16 and the latching mechanisms 18,20, and then inserting the pivot shaft 104 through the aligned pivot shaft support pipes 70,102 so that the torsion spring is located in the cut-away portion 98 of the back portion 92. In this assembled condition, the bottom portion 94 of the latching member 90 forms a third side of the engaging rod receiving channel 74.

One end 110 of the torsion spring 106 presses against one of the upstanding supports 68 of the base member 16, and the other end 112 of the torsion spring 106 presses against the back portion 92 of the latching member 90. The torsion spring 106 biases the corner portion 96 of the latching member 90 toward the side edges 72 of the base member 16 into what shall be considered a retaining position.

Each of the latching members 90 are independently pivotable by an angle of approximately 45 degrees about an axis parallel to the engaging rods 30 and perpendicular to the pins 34 and the tubes 46 from the retaining position to what shall be considered a releasing position by pressing the finger pad 108. The end supports 78 of the base member 16 offset forces placed on the finger pad 108, and limit rotation of the latching mechanisms 18,20 beyond the releasing position. Also, as shown in FIG. 4, the distal end 114 of the bottom portion 94 of the latching member 90 contacts the bottom plate 60 in the retaining position to prevent the torsion spring 106 from biasing the latching member 90 past the retaining position.

The sheet retaining members 12,14 are assembled to the base member 16 by placing the engaging rods 30 into a groove provided by the back portion 92 of the latching member 90 and the side edges 72 of the base member 16. The sheet retaining members 12,14 are then pressed downwardly until the engaging rods 30 are located within the engaging rod receiving channels 74. The back portion 92 of each latching member 90 forms an inclined surface which guides the engaging rod 30 into the engaging rod receiving channel 74. As the engaging rod 30 slides along the back portion 92 of the latching member 90 and into the engaging rod receiving channel 74, the engaging rod 30 moves the latching member 90 out of the way toward the releasing position against the biasing force provided by the torsion spring 106.

Once the engaging rod 30 is located within the engaging rod receiving channel 74, the torsion spring 106 biases the latching member 90 back to the retaining position to securely fasten the sheet retaining members 12,14 to the base member 16. In the retaining position, the bottom portion 94 and corner portion 96 of the latching member 90 prevent the engaging rod 30 from being withdrawn from the engaging rod receiving channel 74, as can be seen in FIG. 4. As shown in FIGS. 2 and 3, one section 116 of the corner portion 96 of each latching member 90 is cut away to receive one of the engaging rod support pipes 28 of the side plates 22.

When the first and second sheet retaining devices 12,14 are assembled with the base member 16, the upper edges 118 of the side plates 22 are substantially aligned with the upper edge 120 of the bottom plate 60.

Figure 6B:
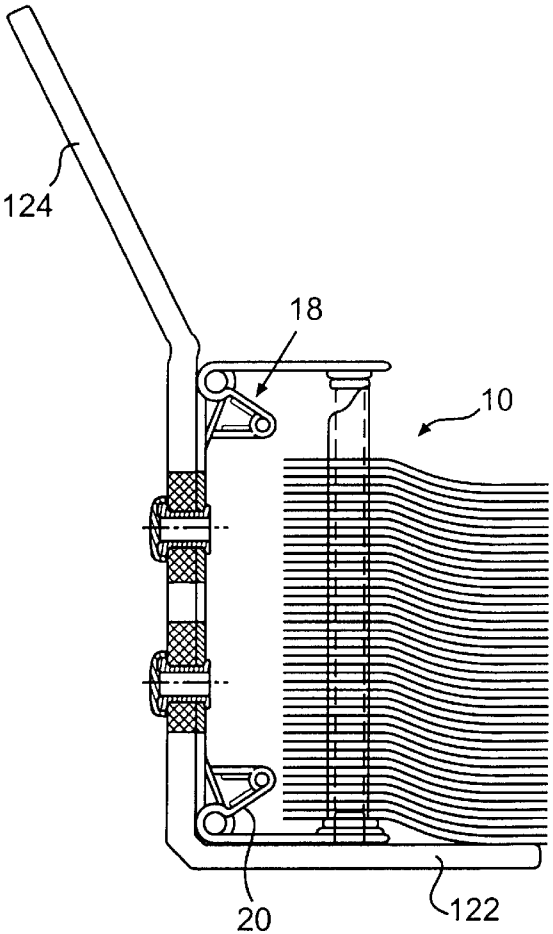
FIGS. 6*a*–6*c* are end views showing the releasing of the pin side of the binding assembly of the present invention.
Figure 6A:
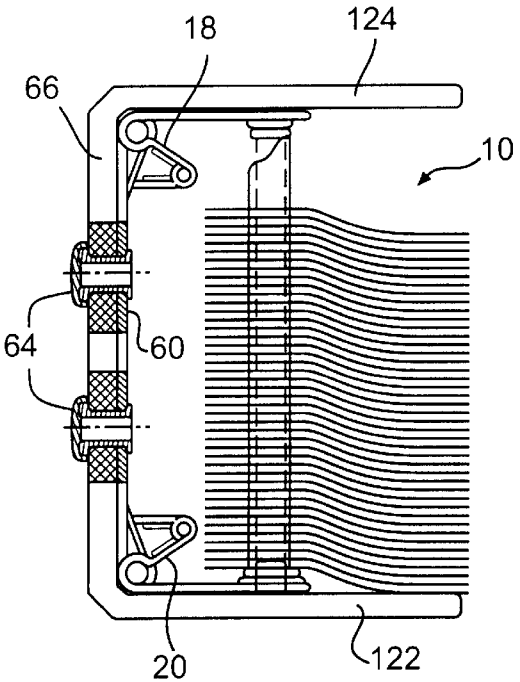
Figure 6C:
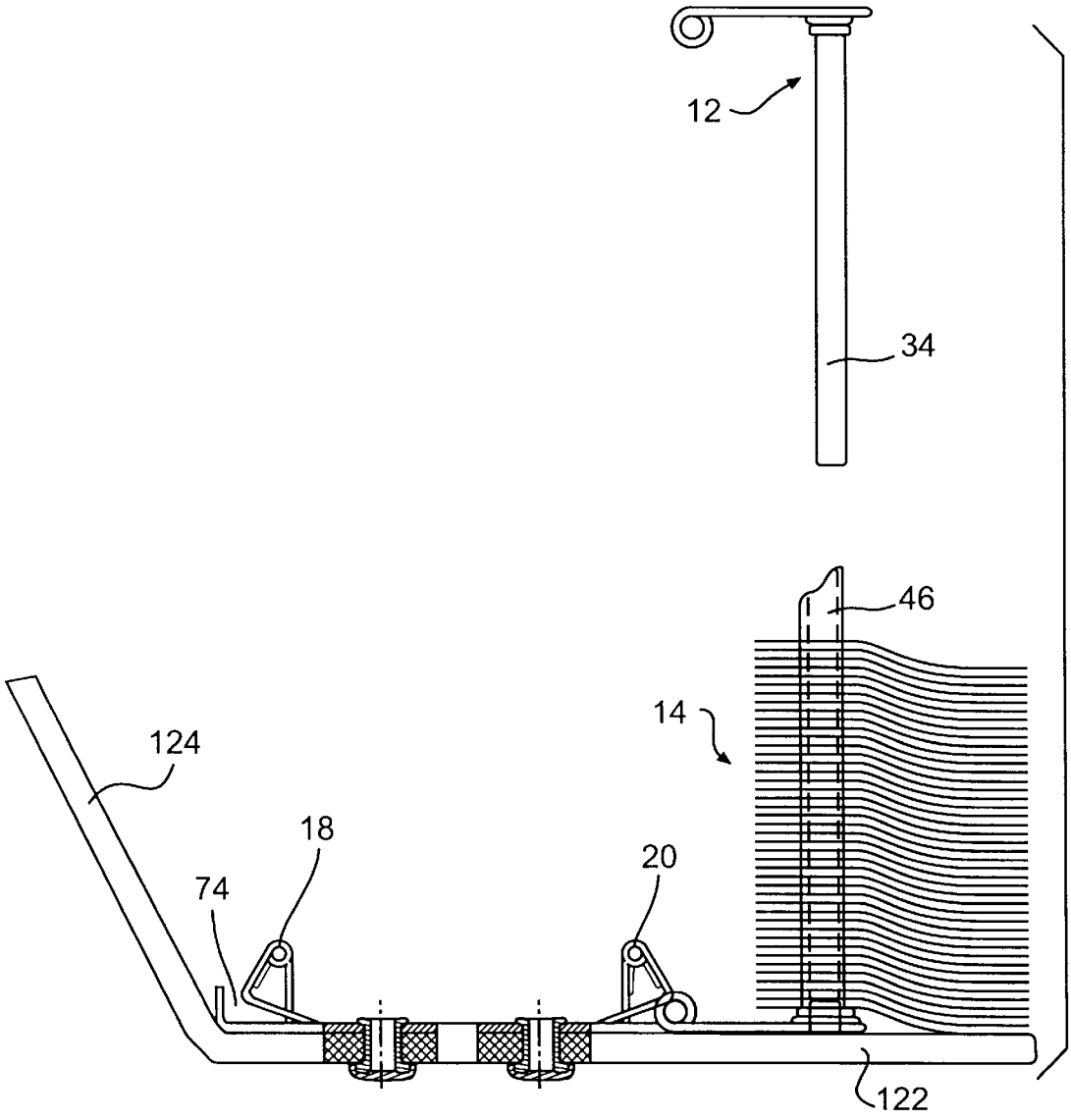

FIGS. 6–8 show various ways of detaching the sheet retaining members 12,14 from the base member 16. FIG. 6*a* shows an end view of a notebook binder with the sheets of paper lying against, for example, a back cover 122 of the binder cover member 66. In FIG. 6*b*, the latching member 90 restraining the sheet retaining member 12 having the pins 34 attached thereto is actuated by depressing the finger pad 108 to release that sheet retaining member 12. Because the sheet retaining member 14 having the tubes 46 attached thereto is still restrained by the engaging rod 30 within the engaging rod receiving channel 74, the base member 16 is pivotal with respect to the sheet retaining member 14 about the engaging rod 30 to the position shown in FIG. 6*c* where the bottom plate 60 of the base member 16 is substantially parallel to the side plate 22 of the sheet retaining member 14. At this time, the sheet retaining member 12 with the pins 34 attached thereto may be removed so that papers still held by the tubes 46 at, for example, a front side of the notebook binder, may be removed or other papers inserted.

Figure 7B:
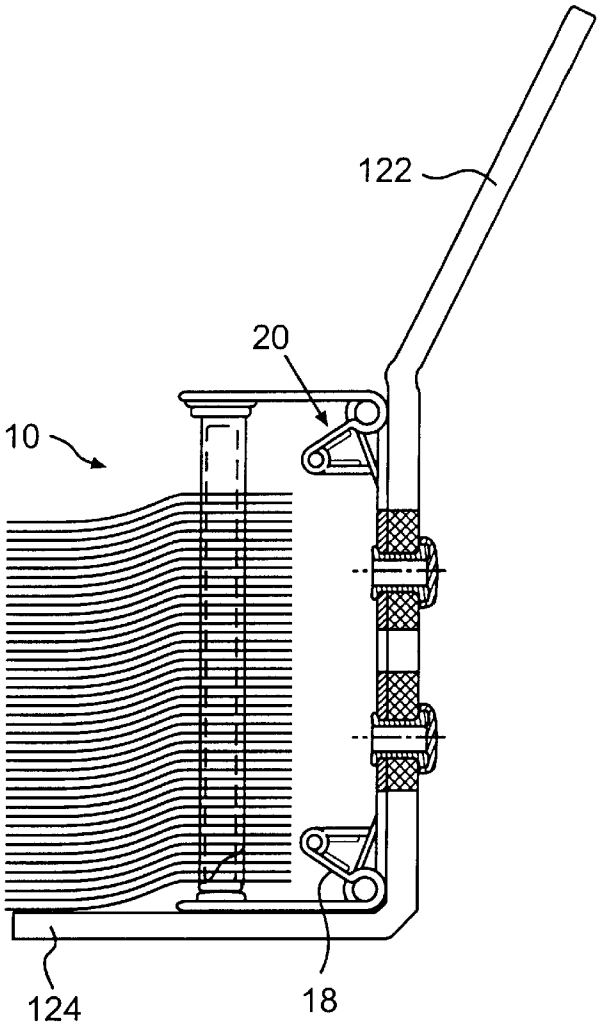
FIGS. 7*a*–7*c* are end views showing the releasing of the tube side of the binding assembly of the present invention.
Figure 7A:
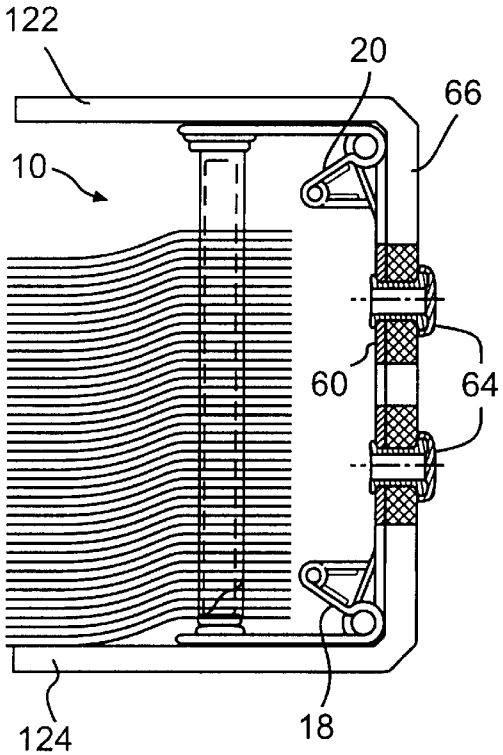
Figure 7C:
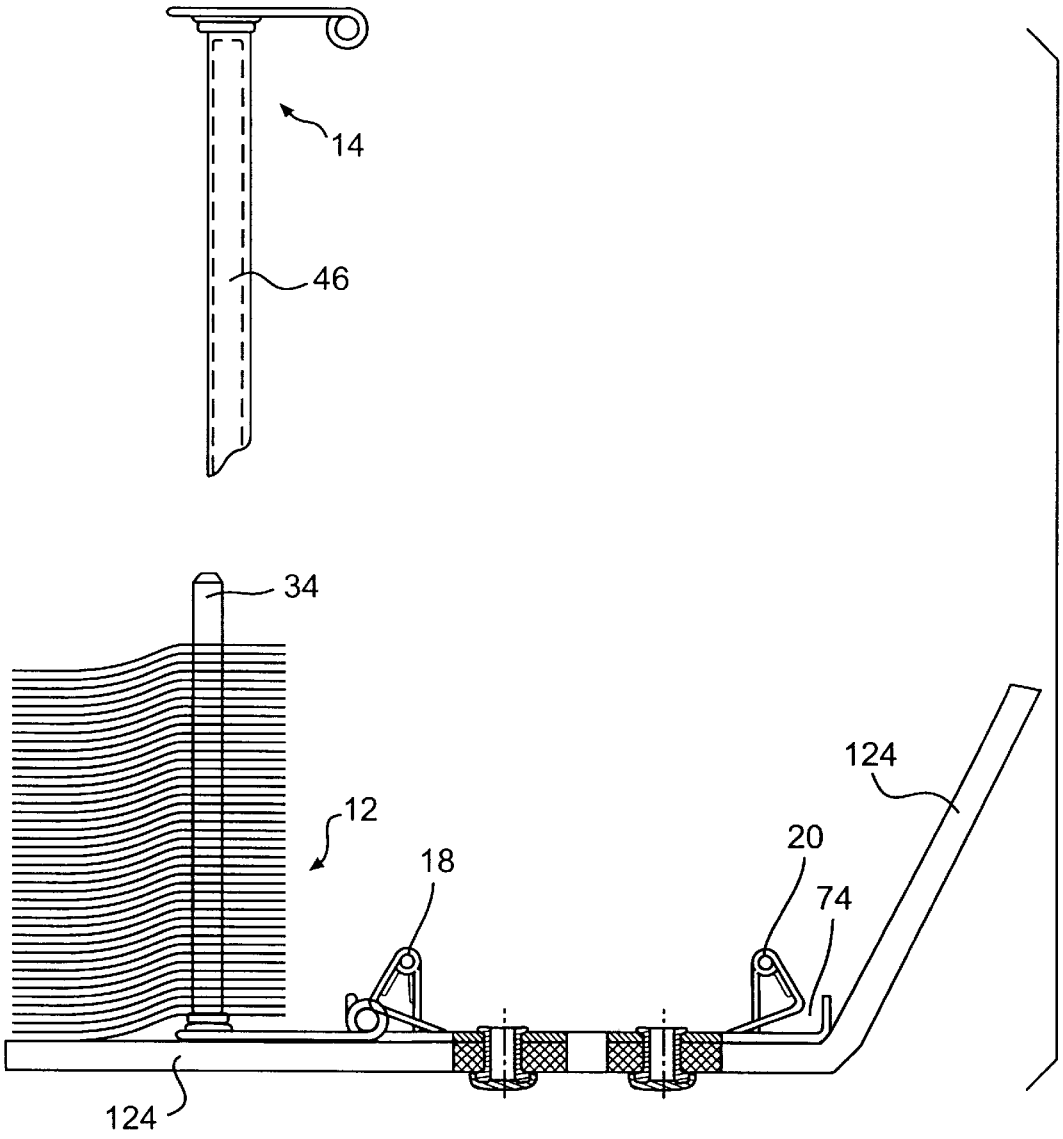

FIG. 7*a* shows an end view of a notebook binder with the sheets of paper lying against, for example, a front cover 124 of the binder cover member 66. In FIG. 7*b*, the latching member 90 restraining the sheet retaining member 14 having the tubes 46 attached thereto is actuated by depressing the finger pad 108 to release that sheet retaining member 14. Because the sheet retaining member 12 having the pins 34 attached thereto is still restrained by the engaging rod 30 within the engaging rod receiving channel 74, the base member 16 is pivotal with respect to the sheet retaining member 12 about the engaging rod 30 to the position shown in FIG. 7*c* where the bottom plate 60 of the base member 16 is substantially parallel to the side plate 22 of the sheet retaining member 12. At this time, the sheet retaining member 14 with the tubes 46 attached thereto may be removed so that papers still held by the pins 34 at, for example, a back side of the notebook binder, may be removed or other papers inserted.

Figure 8B:
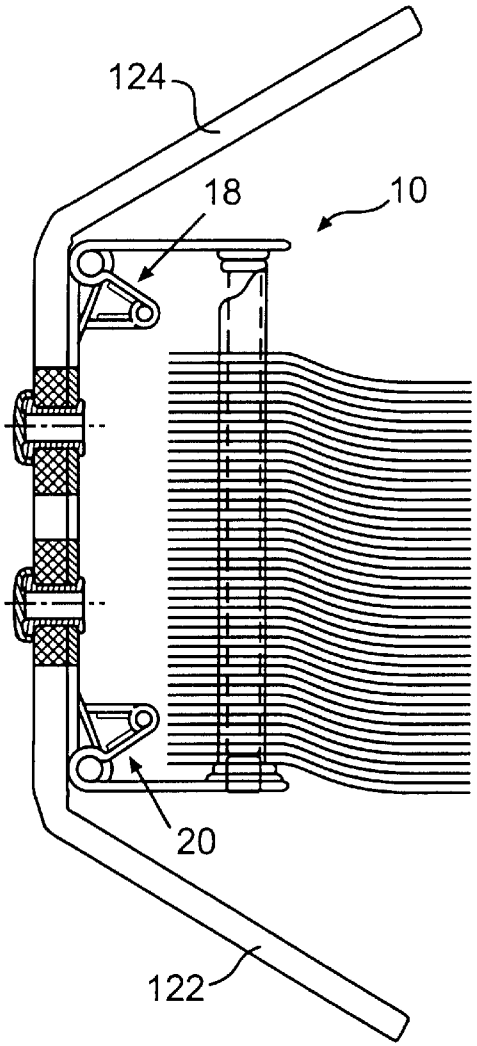
FIGS. 8*a*–8*c* are end views showing the releasing of both the pin side and the tube side of the binding assembly of the present invention.
Figure 8A:
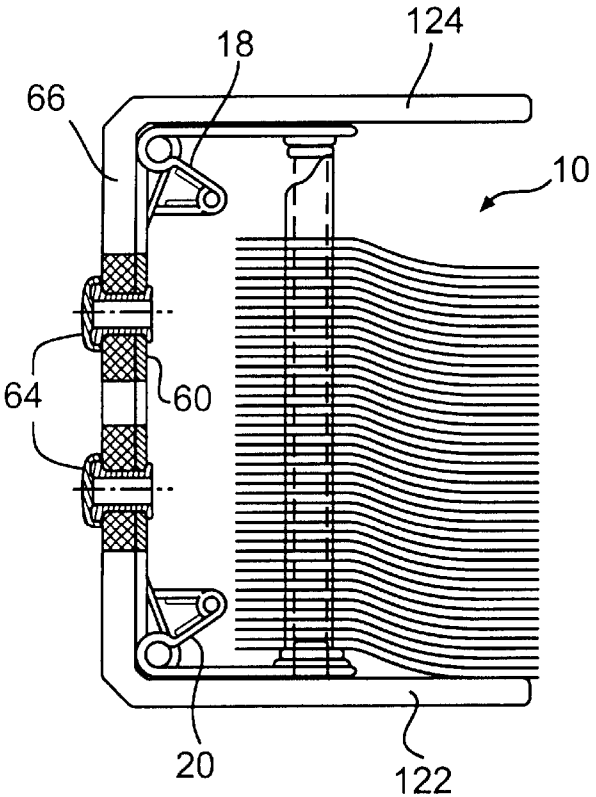
Figure 8C:
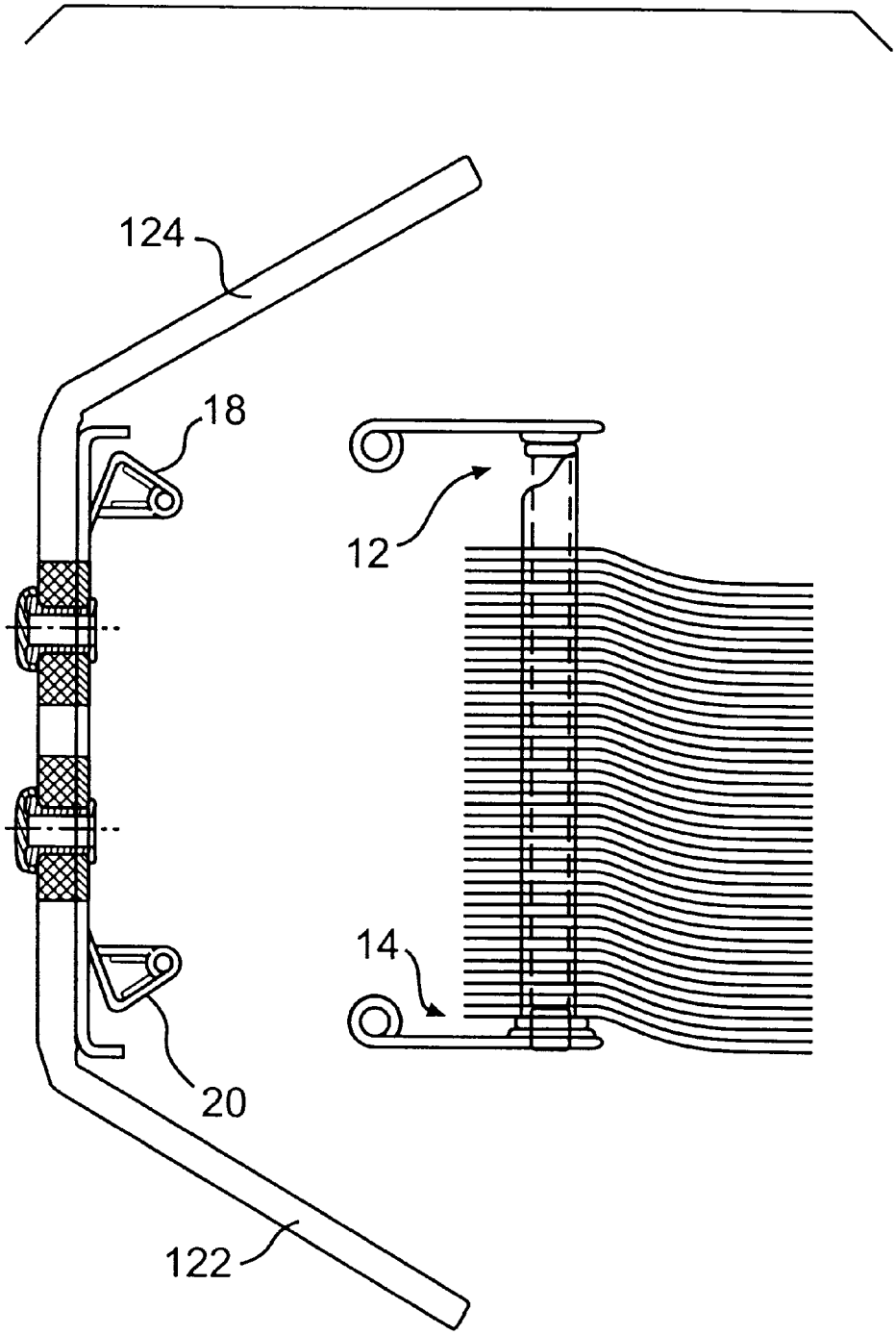

FIG. 8*a* shows an end view of a notebook binder with the sheets of paper lying against, for example, the back cover 122 of the binder cover member 66. In FIG. 8*b*, both latching members 90 restraining both sheet retaining members 12,14 are actuated by depressing the finger pads 108 to release the sheet retaining members 12,14. This allows the sheet retaining members 12,14 to be completely removed together while retaining the sheets in an orderly fashion, as shown in FIG. 8*c*. At this time, the sheet retaining members 12,14 may be relocated into a different binder cover member 66 if desired.

While the present invention has been described with reference to a preferred embodiment with the latching members 90 provided on the base member 16, it is also conceived that the latching members 90 may be located on the sheet retaining members 12,14, with the engaging rods 30 being provided on the base member 16. Further, while the pins 34 and the tubes 46 are preferably straight, it is envisioned that curved pins receivable in correspondingly curved tubes could alternatively be utilized if so desired.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A binding apparatus comprising:

a base member;

a sheet retaining apparatus having at least one pin;

one of said sheet retaining apparatus and said base member including an engaging rod; and a remaining one of said sheet retaining apparatus and said base member including a latching member for securing said sheet retaining apparatus to said base member, said latching member being pivotable from a retaining position where a portion of said latching member engages said engaging rod so that said sheet retaining apparatus is secured to said base member, to a releasing position where said portion of said latching member releases said engaging rod so that said sheet retaining apparatus may be detached from said base member.

2. The binding apparatus according to claim 1, wherein said axis is perpendicular to said pin.

3. The binding apparatus according to claim 1, further comprising a torsion spring for biasing said latching member toward said retaining position.

4. The binding apparatus according to claim 1, wherein said sheet retaining apparatus includes said engaging rod, and said base member includes said latching member.

5. The binding apparatus according to claim 4, wherein said engaging rod extends along a majority of an entire length of said sheet retaining apparatus.

6. The binding apparatus according to claim 4, further comprising:

a pair of spaced-apart support pipes extending upwardly from said base member; and a pivot shaft extending along said latching member, said pivot shaft passing through said pair of spaced-apart support pipes to support said latching member.

7. The binding apparatus according to claim 6, further comprising a torsion spring surrounding a portion of said pivot shaft for biasing said latching member toward said retaining position, one end of said torsion spring contacting one of said support pipes, and another end of said torsion spring contacting said latching member.

8. The binding apparatus according to claim 1, wherein a portion of said latching member has an L-shaped cross section comprising a back portion, a bottom portion, and a corner portion therebetween.

9. A binding apparatus comprising:

a base member;

a sheet retaining apparatus having at least one pin;

one of said sheet retaining apparatus and said base member including an engaging rod; and a remaining one of said sheet retaining apparatus and said base member including a latching member for securing said sheet retaining apparatus to said base member, said latching member being pivotable from a retaining position where said sheet retaining apparatus is secured to said base member, to a releasing position where said sheet retaining apparatus may be detached from said base member, wherein said sheet retaining apparatus includes said engaging rod, and said base member includes said latching member, and wherein said base member further comprises an upstanding end, said end including end supports for offsetting forces applied to said latching member during pivoting of the latching member, and for limiting rotation of the latching member beyond said releasing position.

10. A binding apparatus comprising:

a base member;

a sheet retaining apparatus having at least one pin;

one of said sheet retaining apparatus and said base member including an engaging rod; and a remaining one of said sheet retaining apparatus and said base member including a latching member for securing said sheet retaining apparatus to said base member, said latching member being pivotable from a retaining position where said sheet retaining apparatus is secured to said base member, to a releasing position where said sheet retaining apparatus may be detached from said base member, wherein said sheet retaining apparatus includes said engaging rod, and said base member includes said latching member, and wherein a portion of said latching member has an L-shaped cross section comprising a back portion, a bottom portion, and a corner portion therebetween.

11. The binding apparatus according to claim 10, wherein a distal end of the bottom portion of the latching member contacts the base member in the retaining position to prevent the latching member from moving beyond the retaining position.

12. The binding apparatus according to claim 10, wherein a side edge of the base member forms an engaging rod receiving channel, and the bottom portion of the latching member partially closes an opening of the engaging rod receiving channel when said latching member is in said retaining position to prevent said engaging rod from being withdrawn from said engaging rod receiving channel.

13. A binding apparatus comprising:

a base member;

a first sheet retaining member having at least one tube;

a second sheet retaining member having at least one pin receivable within said tube;

an engaging rod fixed to one of said sheet retaining members; and a latching member provided on said base member for securing said one of said sheet retaining members to said base member, said latching member being pivotable from a retaining position where a portion of said latching member engages said engaging rod so that said one of said sheet retaining members is secured to said base member, to a releasing position where said portion of said latching member releases said engaging rod so that said one of said sheet retaining members may be detached from said base member.

14. The binding apparatus according to claim 13, wherein said engaging rod is fixed to said first sheet retaining member, and further comprising:

a second engaging rod fixed to said second sheet retaining member; and a second latching member provided on said base member for securing said second sheet retaining member to said base member, said second latching member being pivotable from a retaining position where said second sheet retaining member is secured to said base member, to a releasing position where said second sheet retaining member may be detached from said base member.

15. The binding apparatus according to claim 13, further comprising:

a pair of spaced-apart support pipes extending upwardly from said base member;

a pivot shaft extending along said latching member, said pivot shaft passing through said pair of spaced-apart support pipes to support said latching member; and a torsion spring surrounding a portion of said pivot shaft for biasing said latching member toward said retaining position.

16. A binding apparatus comprising:

a base member;

a first sheet retaining member having at least one tube;

a second sheet retaining member having at least one pin receivable within said tube;

an engaging rod fixed to one of said sheet retaining members; and a latching member provided on said base member for securing said one of said sheet retaining members to said base member, said latching member being pivotable from a retaining position where said one of said sheet retaining members is secured to said base member, to a releasing position where said one of said sheet retaining members may be detached from said base member, wherein a portion of said latching member has an L-shaped cross section comprising a back portion, a bottom portion, and a corner portion therebetween.

17. The binding apparatus according to claim 16, wherein a side edge of the base member forms an engaging rod receiving channel, and the bottom portion of the latching member partially closes an opening of the engaging rod receiving channel when said latching member is in said retaining position to prevent said engaging rod from being withdrawn from said engaging rod receiving channel.

18. A method of operating a binding apparatus, comprising the steps of:

providing a base member;

providing a sheet retaining apparatus having at least one pin;

providing an engaging rod on one of said sheet retaining apparatus and said base member;

providing a latching member on a remaining one of said sheet retaining apparatus and said base member; and pivoting said latching member between a retaining position where a portion of said latching member engages said engaging rod so that said sheet retaining apparatus is secured to said base member, and a releasing position where said portion of said latching member releases said engaging rod so that said sheet retaining apparatus may be selectively assembled with or detached from said base member.

19. The method of operating a binding apparatus according to claim 18, wherein said sheet retaining apparatus includes said engaging rod, and said base member includes said latching member.

20. The method of operating a binding apparatus according to claim 18, further comprising the steps of:

providing a second engaging rod on said one of said sheet retaining apparatus and said base member;

providing a second latching member on said remaining one of said sheet retaining apparatus and said base member; and pivoting said second latching member between a retaining position where said sheet retaining apparatus is secured to said base member, and a releasing position where said sheet retaining apparatus may be selectively assembled with or detached from said base member.

21. The method of operating a binding apparatus according to claim 18, further comprising the step of pressing said engaging rod against said latching member to pivot said latching member from said retaining position to said releasing position to assemble said sheet retaining apparatus to said base member.

22. The method of operating a binding apparatus according to claim 18, further comprising the step of providing said latching member with an L-shaped cross section comprising a back portion, a bottom portion, and a corner portion therebetween.

* * * * *